United States Patent [19]

Smith

[11] 4,440,399

[45] Apr. 3, 1984

[54] AMUSEMENT GAME

[76] Inventor: David A. Smith, R.R. #5, Vandalia Acres, Jacksonville, Ill. 62650

[21] Appl. No.: 499,343

[22] Filed: May 31, 1983

[51] Int. Cl.[3] ..... A63B 63/00; A63B 63/06

[52] U.S. Cl. ..... 273/346; 46/47; 273/359; 273/402

[58] Field of Search ..... 273/344–347, 273/359, 369, 370, 398–402; 46/51, 49, 47

[56] References Cited

U.S. PATENT DOCUMENTS

| | | | |
|---|---|---|---|
| 264,416 | 9/1882 | Reynolds | 273/368 |
| 616,244 | 12/1898 | Meyer | 46/47 |
| 1,435,845 | 11/1922 | Hobbs | 46/47 |
| 2,799,587 | 7/1957 | Schwartz | 46/47 X |
| 3,103,362 | 9/1963 | Elofson | 273/359 |
| 3,794,318 | 2/1974 | Holmes | 273/354 X |
| 4,029,316 | 6/1977 | Clarke | 273/346 X |
| 4,126,309 | 11/1978 | Hicks et al. | 273/368 |
| 4,133,526 | 1/1979 | Anson | 273/346 X |
| 4,150,823 | 4/1979 | Boganowski | 273/346 X |

*Primary Examiner*—Paul E. Shapiro
*Attorney, Agent, or Firm*—Wm. A. Snow

[57] ABSTRACT

A game involving a rotating plate having triangular cutouts moving in a track on a vertical rod, with stabilizer plates on both ends of the rod and a ball.

5 Claims, 7 Drawing Figures

AMUSEMENT GAME

BACKGROUND OF THE INVENTION

A search was made on the game and U.S. Pat. Nos. 3,208,751, 3,927,881 and 4,126,309 were found but none of these patents even remotely discloses the present game.

SUMMARY OF THE INVENTION

A game having a vertically-disposed rod with descending spiral grooves or threads thereon for rotating a plate by gravity thereon, the plate having four triangular, equidistantly spaced cutouts therein, upper and lower stabilizer plates one on each end of the rod, the lower of said plates having four equi-distantly spaced, triangular-shaped areas having Velcro thereon on the inner surfaces, and a series of balls containing two strips of Velcro thereon.

DETAILED DESCRIPTION OF THE DRAWINGS

Figure 1:
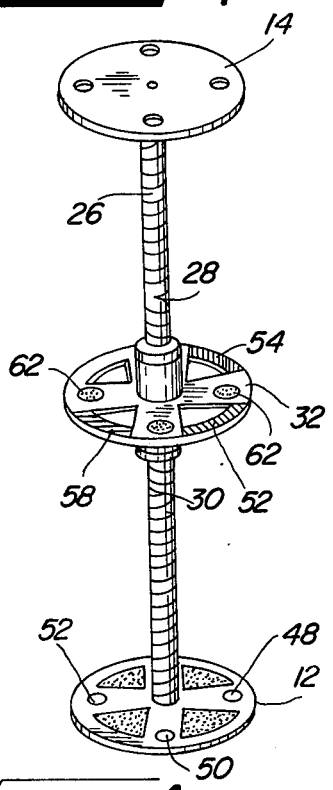
FIG. 1 is a perspective view of the present amusement game.
Figure 2:
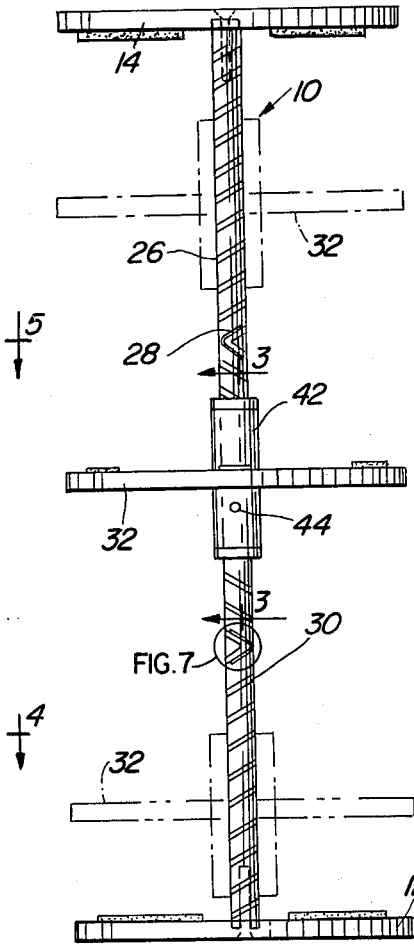
FIG. 2 is a side elevation thereof with parts in broken lines.
Figure 3:
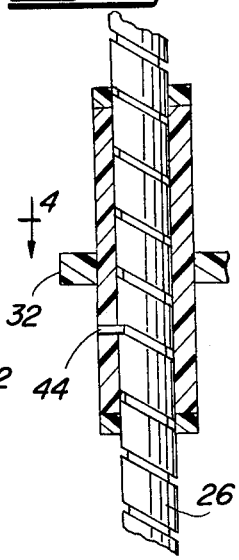
FIG. 3 is a cross-sectional view taken on the lines 3—3 of FIG. 2.
Figure 4:
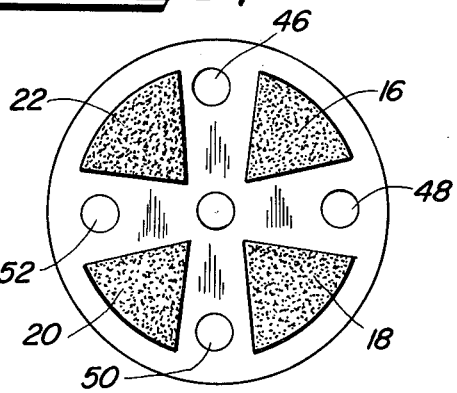
FIG. 4 is an elevational view of the top and bottom stabilizers and showing the inner surfaces thereof taken on lines 4—4 of FIG. 2.
Figure 5:
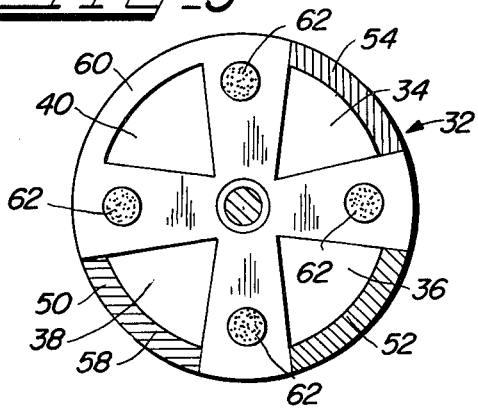
FIG. 5 is a top elevational view of the movable disk or plate taken on lines 5—5 of FIG. 2.

A vertical rod 10 is anchored to a pair of stabilizer disks or plates 12, 14. The rod is preferably about 30½ inches in height and about 1¼ inches in circumference. The plates are approximately 11¼ inches in diameter and ½ inch thick. The inner surface of the circular plates 12 and 14 is marked off with four equi-spaced, triangular-like portions 16, 18, 20, 22 with the base of each of the triangular portions being arcuate shaped. The triangular portions are covered with one part Velcro (such as the looped portion thereof).

The rod 10 is provided with recessed grooves or threads 26 descending from the upper plate 14 towards the lower plate 12 with a pair of reversers 28, 30 positioned about one-third and two-thirds from the top. The reverser 28 merely changes the direction of rotation of the plate or wheel 32 from clockwise to counterclockwise direction and the second reverser 30 reverses the rotation of the plate 32 back to clockwise rotation direction.

The circular plate or wheel 32 is provided with four equidistantly spaced, triangular-like cutouts 34, 36, 38, 40 thereon and secured axially to a bushing 42 medially of the ends of the bushing. A tension screw 44 seats in and through the bushing 42 and the inner end loosely seats in the grooves or threads 26, whereby upon gravitational movement, the plate will rotate. The inner diameter of the bushing 40 is slightly larger than the diameter of the rod 10.

The circular stabilizer plate 14 is provided with four equi-spaced apertures 46, 48, 50, 52 of a size to readily allow the ball 54 to drop therethrough. Each of the apertures 46, 48, 50, 52 is colored with different colors, such as red, blue, green and white.

Also, the portions of circular plate 32 extending beyond the triangular cutouts, i.e., the portions 54, 56, 58, 60, are also colored with corresponding colors.

The purpose of the colors will be described hereinafter.

Also, the plate 32 is provided with round disks of velour 62 situated between the triangular cutouts, the purpose of which will be described later.

Figure 6:
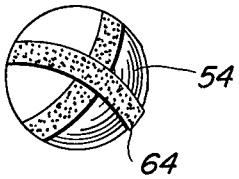
FIG. 6 is an enlarged perspective view of the ball used in this game.
Figure 7:
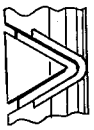
FIG. 7 is an enlarged view taken in the circle in FIG. 2.

The ball 54 is provided with two strips of Velcro 64 (the hooked portion) around its periphery, as seen in FIG. 6.

To play the game, a number of balls 54 are distributed to one or more players. The plate 32 is then moved to be under either plate 12 or 14 and allowed to rotate and the first player must drop a ball through one of the colored apertures 46, 48, 50, 52 in such a manner that as the plate 32 is rotating downwardly by gravity, the ball must drop through the corresponding colored triangular cutout 34, 36, 38, 40 and land on the Velcro 16, 18, 20, 22 which is the target and the player receives ten points. However, if the ball hits the solid area of the plate 32, the player loses two points. If the ball hits any of the velour spots 46, 48, 50, 52, this is also a penalty of five points. Also, if the ball goes through the wrong colored triangular cutout area in plate 32, this is a penalty of ten points. If the ball goes through the correct triangular cutout in plate 32 and misses the Velcro on plate 12, the player still gets five points.

Since the reverses 28 receive the most wear, a strip of polished aluminum 24 is secured therein to reduce wear and tear on the grooves.

It is to be noted that both plates 12, 14 are substantially identical in construction so that when the revolving wheel reaches either plate 12, 14, the device is merely inverted and play begins again.

Although but one specific embodiment of this invention is herein shown and described, it will be understood that details of the construction shown may be altered or omitted without departing from the spirit of the invention as defined by the following claims.

I claim:

1. A game comprising a vertically-disposed rod having recessed spiral grooves therein spaced along its entire length with reversed spiral grooves medially the ends of said rod, upper and lower stabilizer plates secured to said rod at each end thereof and having inner faces, said upper plate having equi-distantly spaced apertures therein, a gravity rotating plate on said rod, equi-distantly spaced, triangular-like cutouts in said rotating plate, said lower stabilizer plate having equidistantly spaced, triangular areas covered with Velcro, and a ball having a strip of Velcro around its periphery.

2. The game according to claim 1 wherein each of the apertures in the stabilizer plates has a different color on its wall, and the area outside the triangular-like cutouts in the rotating plate has corresponding colors.

3. The game according to claim 1 wherein the rotating plate is provided with an axial hub and said hub is provided with a transverse pin extending therethrough and loosely seated in said spiral groove whereby said rotary plate will rotate by gravity.

4. The game according to claim 3 wherein circles of fabric are positioned between said triangular cutouts on said rotary wheel.

5. The game according to claim 3 wherein the outer portions of said rotary plate adjacent said cutouts are colored with various colors, and said apertures in said upper stabilizer plate are colored with comparable colors.

* * * * *